US005261688A

United States Patent [19]

Rohrmoser

[11] Patent Number: 5,261,688

[45] Date of Patent: Nov. 16, 1993

[54] ADJUSTABLE COUPLING DEVICE FOR A SKI

[75] Inventor: Alois Rohrmoser, Wagrain, Austria

[73] Assignee: Varpat Patentverwertungs AG, Littau, Switzerland

[21] Appl. No.: 809,461

[22] Filed: Dec. 17, 1991

[30] Foreign Application Priority Data

Dec. 21, 1990 [AT] Austria ..... 2630/90

[51] Int. Cl.[5] ..... A63C 9/00

[52] U.S. Cl. ..... 280/617; 280/633

[58] Field of Search ..... 280/617, 616, 633, 607, 280/618

[56] References Cited

U.S. PATENT DOCUMENTS 3,987,553 10/1976 Salomon ..... 280/616
4,067,593 1/1978 Earl ..... 280/633
5,149,123 9/1992 Rohrmoser ..... 280/633

FOREIGN PATENT DOCUMENTS 2246668 4/1974 Fed. Rep. of Germany ..... 280/617
2617395 4/1976 Fed. Rep. of Germany ..... 280/633
3523058 6/1985 Fed. Rep. of Germany .
3932438 4/1990 Fed. Rep. of Germany ..... 280/617

*Primary Examiner*—David M. Mitchell
*Attorney, Agent, or Firm*—Kurt Kelman

[57] ABSTRACT

An adjustable coupling device for coupling a ski boot to a ski. The coupling device has a longitudinal axis and includes, a toe binding, a heel binding and length adjustment device. The length adjustment device is capable of altering the distance between the toe binding and the heel binding along the longitudinal axis to accommodate different-size ski boots. The length adjustment device has a first drive element connected to the toe binding and a second drive element connected to the heel binding. The drive elements can be moved and set at a position corresponding to the length of the ski boots. An attachment device is provided to attach one of the bindings to a surface of the ski at one of several preset positions in such a manner that the remainder of the coupling device can move freely in a direction perpendicular to the surface. Alternatively, the attachment device may attach both of the bindings to the surface.

11 Claims, 11 Drawing Sheets

Fig.20
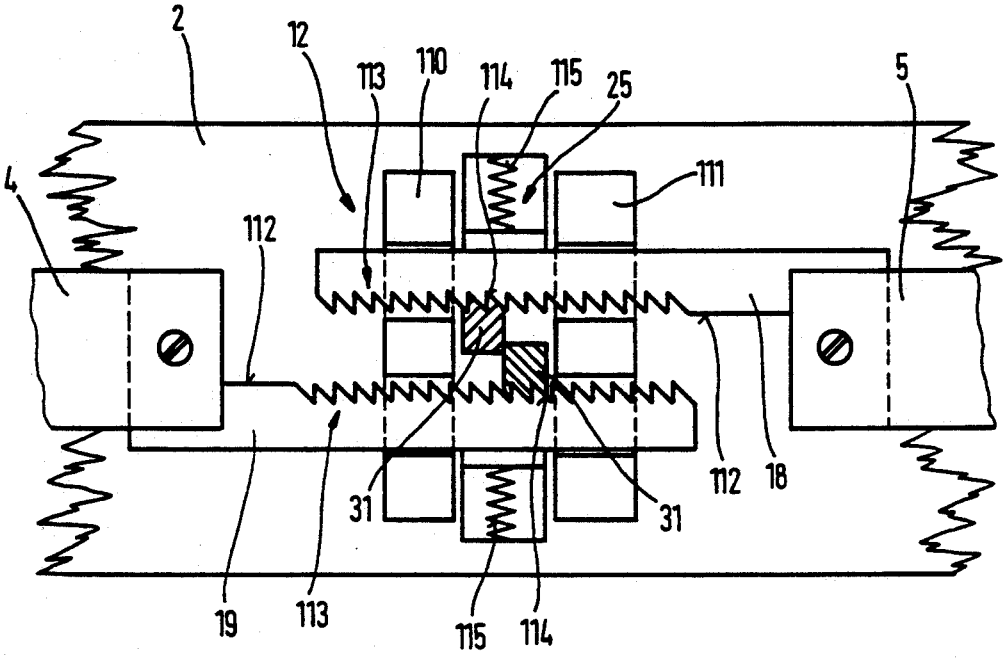
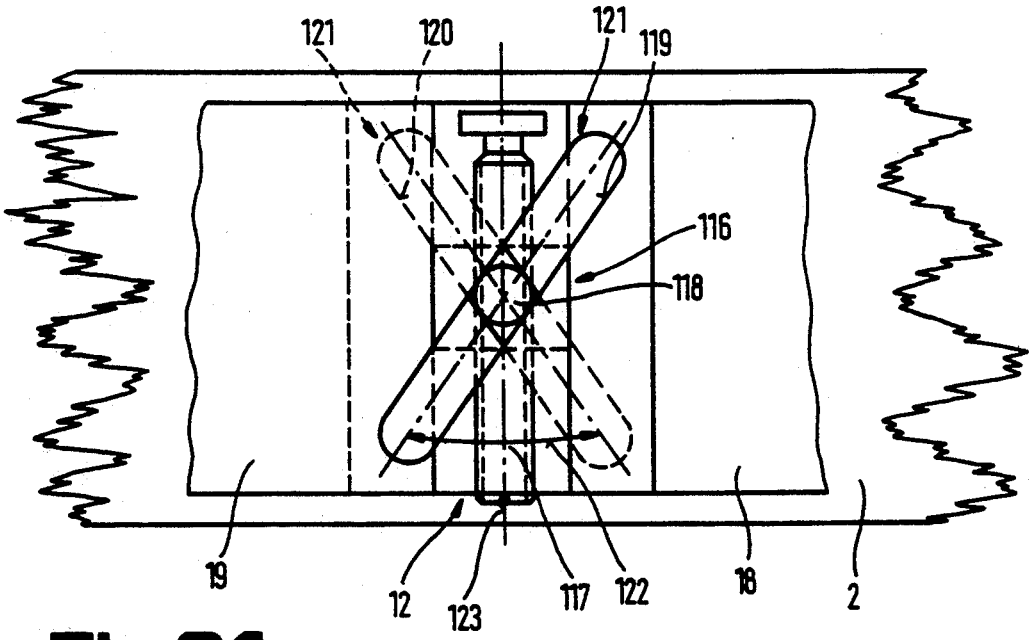
Fig.21

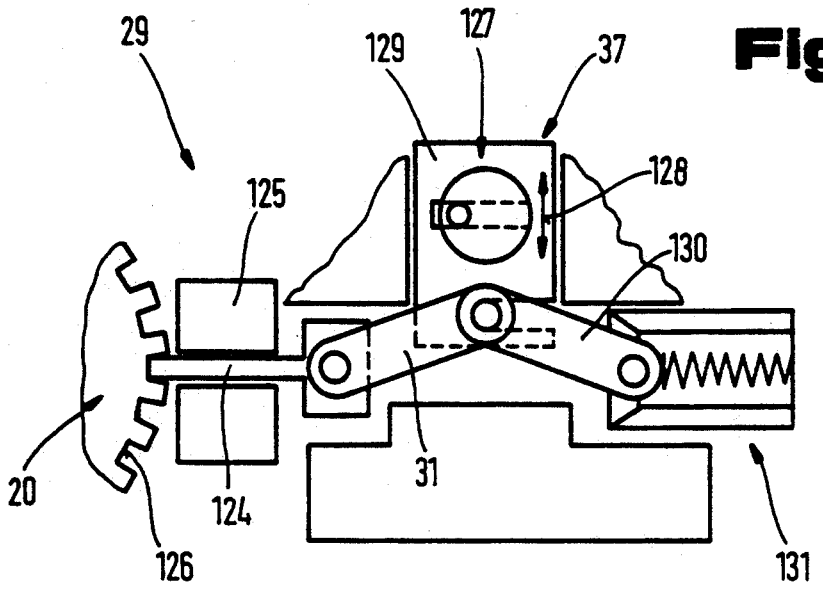
Fig.22
Fig.23
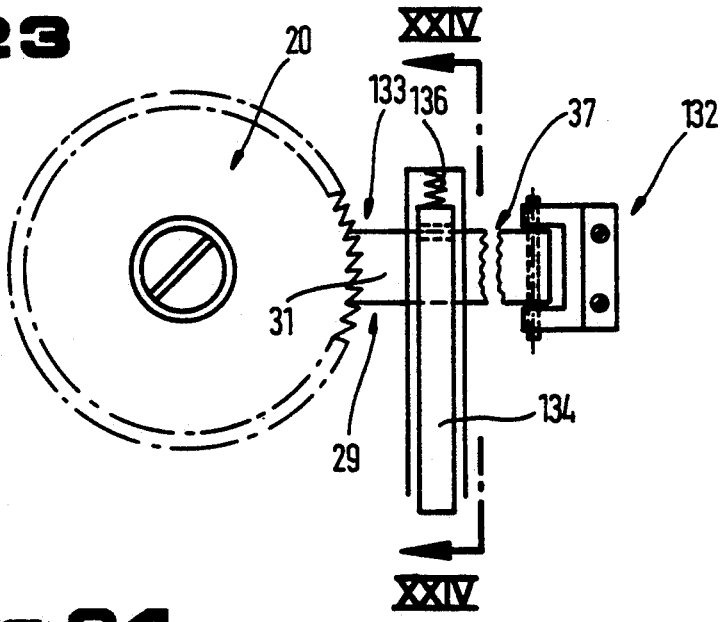
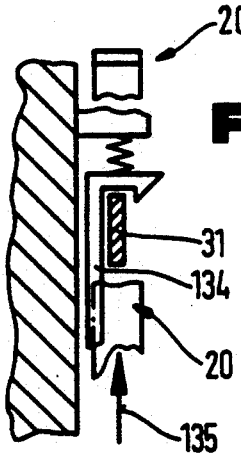
Fig.24
Fig.25
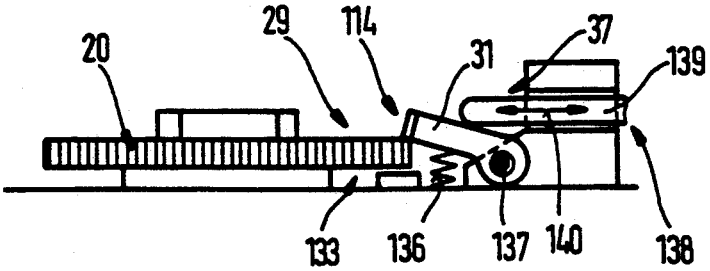

ADJUSTABLE COUPLING DEVICE FOR A SKI

BACKGROUND OF THE INVENTION

1. Field of the Invention

The invention relates to a coupling device for a ski with a toe and heel binding. More particularly, it relates to an adjustable coupling device.

2. Description of the Prior Art

Ski bindings which are adjustable to different size ski boots are known from DE-OS 22 46 668 in which a toe binding and a heel binding are coupled together with gear means which work in opposite directions. These toe and heel bindings can be adjusted relative to the ski and relative to each other to adapt to different boot sizes. To adjust the distance between the toe and heel bindings, the toe binding is moved a distance which is a multiple of the distance the heel binding is moved. With such a binding, the preselected settings cannot be precisely maintained. Additionally, the ski is made much more rigid in the are of the binding, and the stress between the binding and the ski boot is increased.

SUMMARY OF THE INVENTION

It is, therefore, an object of the present invention to eliminate the afore-mentioned drawbacks of the prior art and to provide a coupling device which is of simple construction and easily adjusts to accommodate different size ski boots.

It is a further object of the present invention to provide such a device which allows the ski to maintain its flexibility in the area of the coupling device.

It is yet another object of the present invention to provide such a device where the toe and heel bindings each move the same distance in relation to a center point of the ski.

These and other objects are attained according to the invention by an adjustable coupling device for coupling a ski boot to a ski. The coupling device has a longitudinal axis which is generally parallel to the longitudinal axis of the ski. The coupling device includes a toe binding and a heel binding. In addition, length adjustment means are provided for altering the distance between the toe binding and the heel binding along the longitudinal axis. This adjustment allows the coupling device to accommodate different size ski boots. The length adjustment means has a first drive element connected to the toe binding and a second drive element connected to the heel binding. The coupling device also includes means for moving the drive elements and means for setting the drive elements at a position corresponding to the length of the ski boot. Attachment means are provided to attach one of the bindings to a surface of the ski at one of several preset positions so that the remainder of the coupling device can move freely in the direction perpendicular to the surface.

The attachment means may alternately attach both of the bindings to a surface of the ski.

The drive elements are movable synchronously and in opposite direction from each other. The length adjustment means includes locking means to lock the drive elements in place. Alternatively, at least one of the bindings may include locking means to lock the drive elements associated with the binding in place.

The attachment means are formed from a connection element which is deformable perpendicular to the surface of the ski and is resistant to deformation in a direction parallel to the surface. The attachment means can alter the position of the length adjustment means along the longitudinal axis of the ski. The connection element is formed of two parts connected together by a turn buckle so that the length of the connection element can be altered. This allows sensitive, almost infinite setting or adjustment of the coupling device. The attachment means has a plurality of preset positions located along the longitudinal axis of the ski. This allows a rapid predefined change of the traveling behavior of the ski to adapt to different operating conditions, such as soft or hard trails.

The length adjustment means can be provided with locking means for locking the length adjustment means at a particular setting. The locking means include a locking plate which is adjustable between a closed position and an open position. These locking means prevent movement of the length adjustment means when placed in the closed position. The locking means may preferably lock the drive elements against movement in the longitudinal direction as well as in a direction perpendicular to the surface.

At least one of the bindings includes locking means and a longitudinal guide for guiding the drive elements. The locking means are movable from a first engaged position in which the longitudinal guide is locked with respect to the bindings and an unlocked position in which the longitudinal guide is free to move with respect to the bindings.

The locking means may alternatively adjusted between a closed position and an open position. The locking means can be formed by a coupling which is located between the drive elements. The coupling is uncoupled when the locking means is in a closed position. Correspondingly, the coupling is coupled when the locking means is in the open position. The locking means may be located, for example, between the toe and heel bindings.

The attachment means may be located, for example, between the drive elements and the ski. The attachment means may alternatively located between longitudinal guides and the ski. This allows unrestricted positioning of the length adjustment device on the ski.

The coupling device may advantageously include a height and width guide track which extends in a longitudinal direction and is connected for movement with the ski. Additionally, a locking screw is provided which is located between at least one of the bindings and a longitudinal guide and between a longitudinal guide and the height and width guide track. The height and width guide track has a reduced moment of resistance in a direction perpendicular to the surface of the ski. The height and width guide track is formed by an approximately T-shaped strip with a web height which is shorter than its shank length. Due to the low web height, the deformation characteristics of the ski are not detrimentally altered. The height and width guide track is preferably at least as long as a guide length for the longitudinal guide plus half the distance between the largest and the smallest boot size. Half the distance between the largest and smallest boot size may be 4 cm, for example. The height and width guide track may be integrally formed as one piece. The height and width guide track may optionally be integrated into a top layer of the ski surface. The height and width guide track may also be countersunk into the ski surface and form part of a top belt.

The length of the longitudinal guides may be greater by at least a setting range of the length of the attachment means and the difference between the arc and chord dimension when the ski is bent and a minimum guide length of the bindings.

The locking means, the attachment means and the locking screw may be formed by a bayonet socket. The locking means, the attachment means and the locking screw may alternatively be formed by a screw connection or a catching screw connection.

The coupling device also includes a release adjustment for setting the release point on the bindings. The locking means, the attachment means and the release adjustment may be formed, for example, by a worm drive. The locking means, the attachment means and the release adjustment may alternatively be formed by a screw spindle and migrating nut arrangement. The length adjustment means, the attachment means and the release adjustment may be coupled together with a ratchet drive. The locking means and the locking screw may be coupled with a safety lock which prevents use of the coupling device and projects into the area holding the ski boot. The locking means and the locking screw may be provided with a locking element which prevents operation of the bindings in the open position. The drive elements, the longitudinal guide and the height and width guide track may be provided, for example, with locking elements of the locking device.

The locking means, the length adjustment means and the attachment means are provided with locking screws in their end positions in the form of beyond-dead-point locks.

The coupling device may additionally include a ski brake which is attached to the ski by means of a releasable connection device. The ski brake may be attached to the height and width guide track by means of a releasable connection device. The ski brake may alternatively be attached to the connection element by means of a releasable connection device.

BRIEF DESCRIPTION OF THE DRAWINGS

The above and other objects, advantages and features of this invention will now be described in detail in connection with certain now preferred embodiments thereof, taken in conjunction with the accompanying, partly schematic (?) drawing wherein

FIG. 20 is an enlarged top plan view, in partial cross section, of an alternate embodiment of the lock;

FIG. 21 is an enlarged top plan view of another embodiment of the coupling device with an adjustable guide tab;

FIG. 22 is an enlarged view of an alternate embodiment of the lock with a bending lever and a fixing device;

FIG. 23 is an enlarged top plan view of a further embodiment of the lock with a fixing device assigned to it;

FIG. 24 is an enlarged cross-sectional view taken along line XXIV—XXIV of FIG. 23;

FIG. 25 is an enlarged side view of another embodiment of the lock which can be activated via the ski.

DETAILED DESCRIPTION OF THE PREFERRED EMBODIMENT

Figure 1:
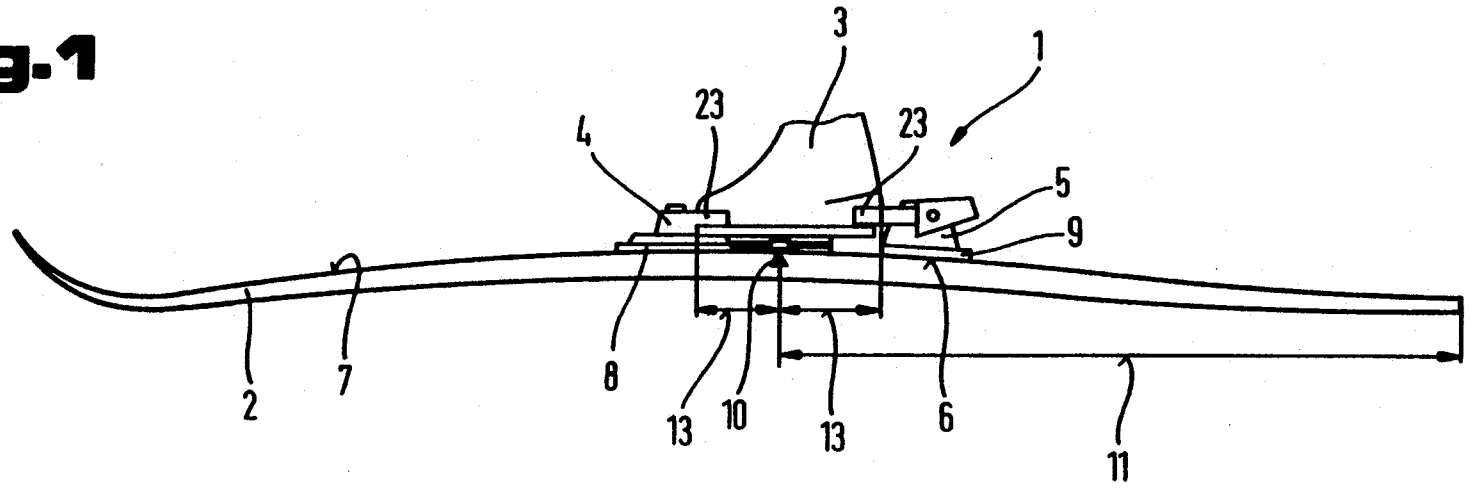
FIG. 1 is a side elevational view of a ski with a coupling device embodying the present invention.

Referring now in detail to the drawings and in particular to FIGS. 1 to 6, there is illustrated a coupling device 1 for attaching a ski boot 3 to a ski 2. Coupling device 1 can be used as a ski binding or to hold a ski boot in place for repair or assembly. Coupling device 1 can also be used for adjustment and setting of binding parts, and as a demonstration model for explaining the function of a binding or the relationship between a ski boot and a ski, or a ski boot and a binding.

Coupling device 1 includes a toe binding 4 and a heel binding 5 which are attached by longitudinal guides 8, 9 to a fixed plane 6, which is normally formed by a surface 7 of ski 2.

Boot 3 is held in place relative to an assembly point 10 by means of coupling device 1. This point is located a distance 11 from one end of the ski, which usually corresponds to half the length of ski 2.

Figure 2:
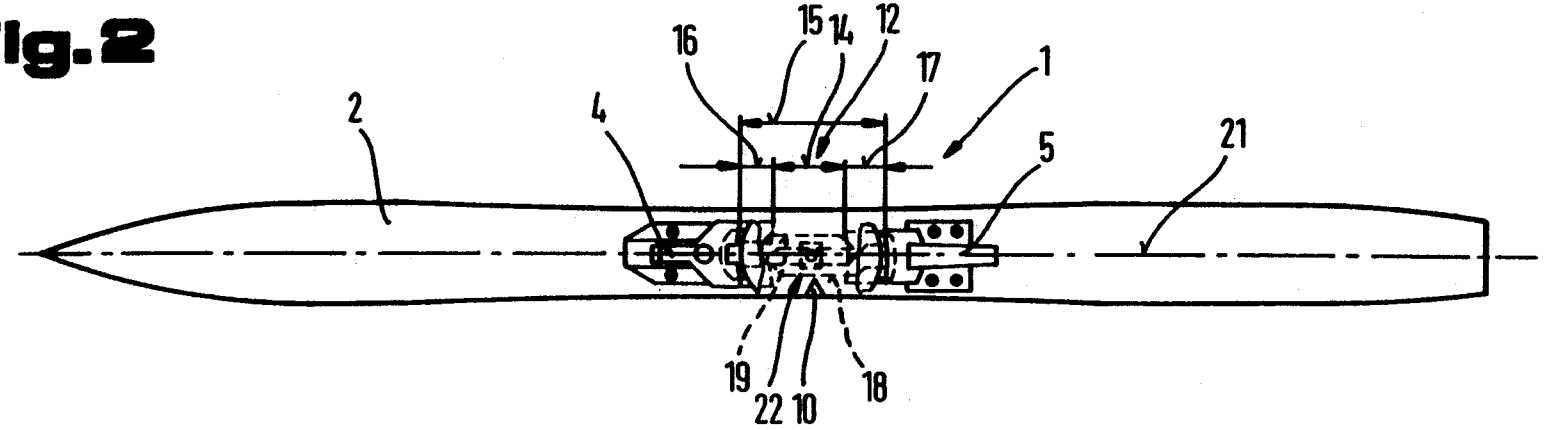
FIG. 2 is a top plan view in partial cross section of the ski and coupling device shown in FIG. 1.

A length adjustment device 12, clearly shown in FIG. 2, secures both toe and heel bindings 4, 5 in place at a distance 13 from assembly point 10. The distance between toe and heel bindings 4 and 5 can be varied from distance 14 to distance 15 while each binding 4 and 5 maintains the same distance from assembly point 10. The difference between distance 15 and distance 14 is adjustment path 16 and 17 which corresponds to the difference between the smallest ladies' ski boot size and the largest men's ski boot size.

By means of length adjustment device 12, the toe binding 4 and the heel binding 5 can be adjusted relative to one another and to ski 2, in the direction of a longitudinal axis 21, by means of drive elements 18, 19 and gear 20. Toe and heel bindings 4, 5 can be fixed or locked in place in the various positions by means of a lock 22, so that the distance between toe and heel bindings 4, 5 can be maintained. Once bindings 4, 5 are fixed in position, precise adjustment of the tension for toe and heel bindings 4, 5 can be made, i.e. the toe and heel clamps 23.

Figure 4:
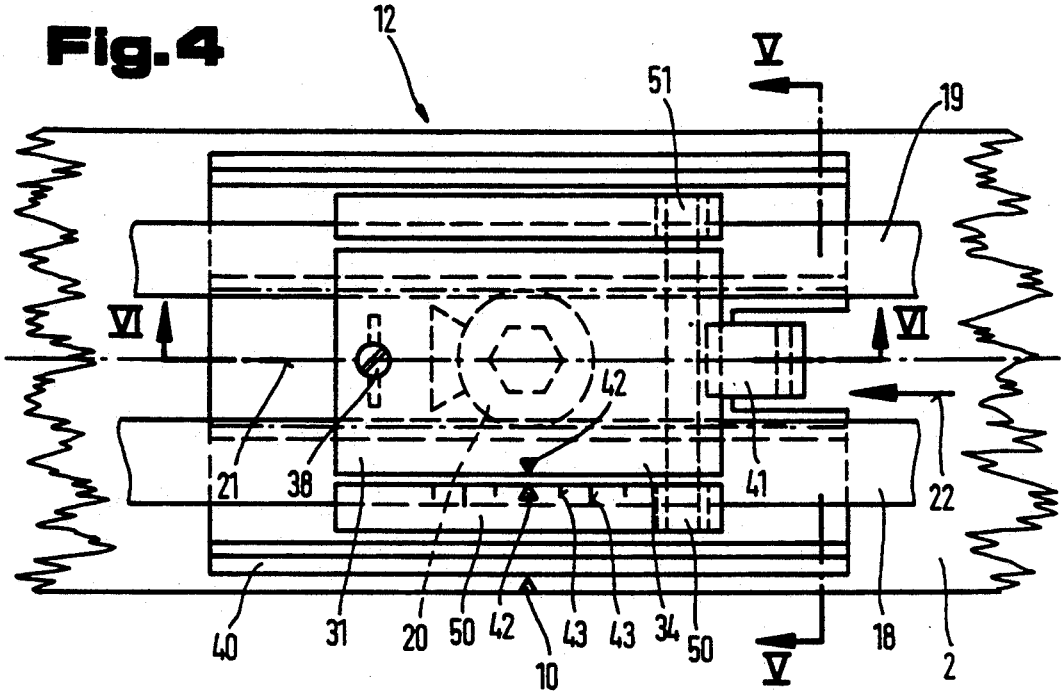
FIG. 4 is an enlarged top plan view of the coupling device.
Figure 5:
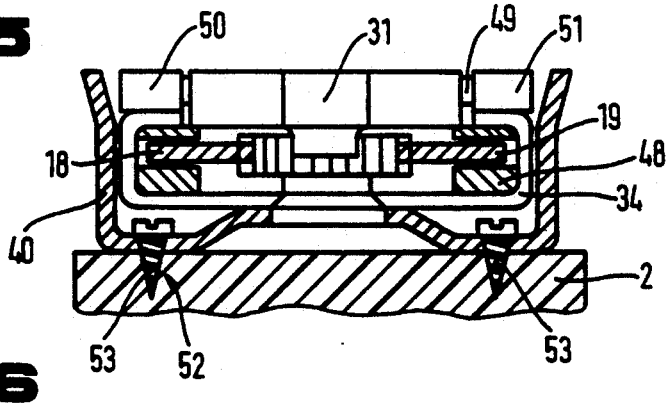
FIG. 5 is an enlarged cross-sectional view taken along line V—V of FIG. 4.
Figure 6:
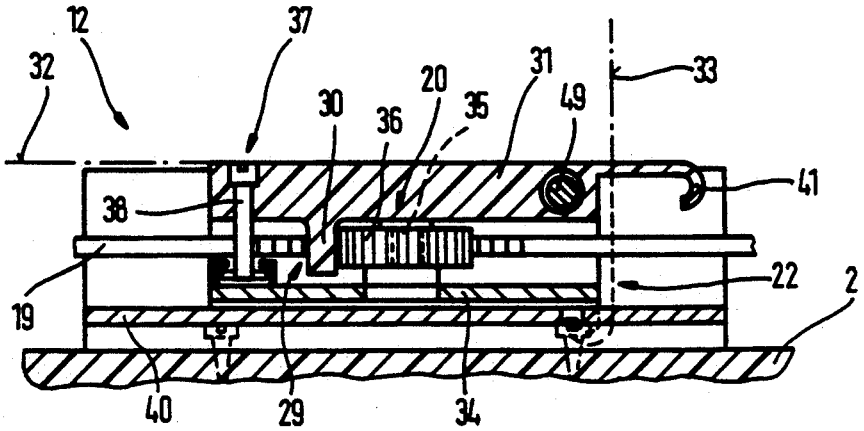
FIG. 6 is an enlarged cross-sectional view taken along line VI—VI of FIG. 4.

As shown in FIGS. 4 to 6, adjustment of drive elements 18, 19 is controlled by central gear 20. Drive elements 18 and 19 are moved synchronously but in opposite directions of each other. Thus, when the binding 4 is moved along adjustment path 16, heel binding 5 is moved the same distance along adjustment path 17. This makes it possible for the center point of coupling device 1 to remain at assembly point 10 of ski 2, or of an assembly device or a demonstration model, in spite of the adjustment. It should be noted that it is not critical whether the adjustment or change of distance 14 or 15 takes place by displacement of the toe and/or heel bindings 4, 5 or by forced activation of gear 20. In each case, synchronous adjustment of the toe and heel bindings 4, 5 in opposite directions is ensured by the connection which exists between the drive elements 18, 19 with gear 20.

In order to precisely adjust coupling drive 1, a safety binding release adjustment 24 is provided. Release adjustment 24, which can be part of toe binding 4 or heel binding 5 adjusts the contact pressure between bindings 4 and 5 and may also adjust clamps 23, as shown schematically in FIG. 3. A housing 25 of heel binding 5 can be adjusted along a guide track 26 relative to a base plate 27. In this manner, when ski boot 3 engages clamp 23, pressure spring 28 is properly adjusted. Before adjusting release adjustment 24, however, it is necessary to hold coupling device 1, particularly toe binding 4 and heel binding 5, in their fixed preliminary position. A locking device 22, as seen in FIG. 4 and 6, formed by a catch 30 of a locking plate 31, may be utilized. Before the distance 14 or 15 between bindings 4, 5 is altered, locking plate 31 is pivoted up from a closed position 32, shown in solid lines, into an open position 33, shown in phantom lines. Catch 30 is thus disengaged from gear 20, which is formed by a gear wheel 36 which can be rotated on an axis 35 in a housing 32. Prior to moving locking plate 31 from closed position 32 into open position 33, a locking screw 37 must first be released. After the front and heel bindings 4, 5 have been adjusted to the desired distance 14, 15, catch 30 is brought into engagement with gear 20 again, and locking plate 31 is pivoted back to closed position 32 and secured in position with locking screw 37.

Locking screw 37 can be formed by a rotating locking pin 38 of an eccentric bolt or any other locking device known from the state of the art.

However, in order to ensure that toe binding 4 and heel binding 5 are located at the desired distance from assembly point 10, coupling device 1 or length adjustment device 12 must be additionally positioned along longitudinal axis 21. This is achieved with variable attachment means 39 which can be arranged at desired locations along the length of coupling device 1. It should be noted that with the embodiment shown it is not possible to make a direct permanent connection between the holder housing 34 of length adjustment device 12 and ski 2 via screw connections. This would result in an additional reduction of the distance 14 or 15 between bindings 4, 5 when ski 2 bends, as shown schematically in FIG. 3 in phantom line. This problem would be exaggerated, particularly if bindings 4 and 5 are freely movable along longitudinal guides 8, 9. Accordingly, in the present embodiment the longitudinal positioning of coupling device 1 is maintained by variable attachment means 39 which are located in the vicinity of toe binding 4. Variable attachment means 39 can be structured similar to devices known from EP-OS 0 084 324 or DE-OS 32 14 585, for example. Coupling device 1 will, therefore, be located at assembly point 10 once bindings 4, 5 have been aligned relative to the assembly point 10, as is already known from DE-PS 31 09 754, for example.

In order to ensure that the adjustment of bindings 4, 5 takes place synchronously relative to assembly point 10, lock 22 is arranged in the area of length adjustment device 12. With lock 22, holder housing 34 of length adjustment device 12 can be fixed in place on a base plate 40 which is affixed to ski 2, during the adjustment process. For this purpose, locking plate 31 of locking device 29 is provided with an additional locking bolt 41, which engages with base plate 40 in its open position 33. This engagement fixes length adjustment device 12 in place during the adjustment process, with reference to assembly point 10, preferably centered above the assembly point 10. Centering marks 42 can be arranged on base plate 40 and holder housing 34, with positioning marks 43 placed on either side of center marks 42 on base plate 40 or holder housing 34. These positioning marks 43 can then be used to position coupling device 1 in the direction of the longitudinal axis of the binding of ski 2, independent of set distance 14 or 15 between the toe and heel bindings 4, 5. This positioning takes place subsequent to adjustment of the desired distance after release of lock 22 and is carried out by means of variable attachment means 39 in the area of toe binding 4.

The advantage of the structure of length adjustment device 12 according to the invention is that the entire coupling device 1 is only fixed in place on ski 2 at one point, namely in the region of binding 4. Ski 2 can thus move completely unhindered relative to heel binding 5, as well as length adjustment device 12, in the longitudinal direction. In addition, length adjustment device 12 can also move freely in the vertical direction relative to plane 6, i.e. surface 7 of ski 2, and thus additional stress between clamps 23 of bindings 4, 5 and ski boot 3 is avoided.

In order to ensure free mobility of ski 2 during deformations both in the direction of ski boot 3 and in the opposite direction, care is necessary to ensure that a distance 44 between surface 7 and a boot sole 45 is greater than the height of length adjustment device 12. This is brought about, for by correspondingly arranged standing plates 46, which can be simultaneously provided with friction-reducing coverings, for example slide plates or similar, to reduce release forces, especially in the area of toe binding 4. Standing plates 46, 47 are preferably connected with drive elements 18, 19 or base plate 27 or housings 25 of the toe and/or heel bindings 4, 5, as indicated schematically in the present embodiment.

However, it is also permissible to attach these standing plates 46, 47 independently to the ski, in addition to the aforementioned parts.

For tight fighting and friction-free guidance of drive elements 18, 19, guide strips 48 can be arranged in the holder housing 34. Guide strips 48 can be formed by a C-shaped bent metal profile. Between guide strips 48 and drive elements 18, 9, a layer of material such as Teflon TM or a similar material, for example, may be placed to reduce friction during adjustment.

The individual parts of coupling device 1, lock 22, locking screw 37 and length adjustment device 12 as well as locking device 29 can be formed of plastic, particularly injection molded parts.

Base plate 40 which supports length adjustment device 12, if necessary, can be provided with a narrow base to attach to ski 2 closer to the longitudinal central axis. This would reduce tilting of length adjustment device 12 relative to ski 2.

As can be seen in FIGS. 3 to 6, in particular, locking plate 31 can be pivoted around an axis 49. Axis 49 is held by blocks 50, 51 of holder housing 34. In its open position 33, locking plate 31 projects into the area of the ski boot 3, so that placement of a ski boot into the binding and use of the binding is reliably prevented if locking device 29 is not engaged. Blocks 50, 51 can be riveted onto holder housing 34, screwed onto it, or injection-molded onto it by plastic injection molding. Base plate 40, in contrast, is attached to ski 2 by attachment means 52, e.g. screws 53. Likewise, the connection between drive elements 18, 19 and toe and heel bindings 4, 5 or standing plates 46, 47 can be attached with attachment means 54, which can also be formed by screws or rivets. The longitudinal guides for bindings 4, 5, in contrast, are directly connected with ski 2 by attachment means 52.

Figure 7:
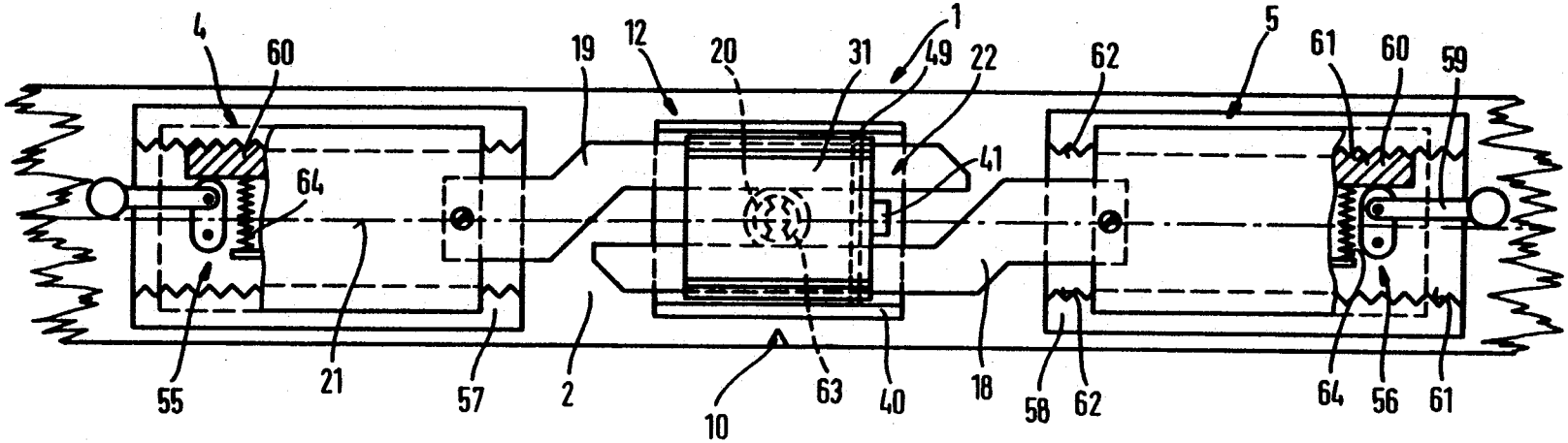
FIG. 7 is an enlarged top plan view, in partial cross section, of an alternate embodiment of the coupling device with the locking devices as part of the toe and heel bindings.

FIG. 7 shows another embodiment of coupling device 1 structured according to the invention, arranged on ski 2. Toe binding 4 and heel binding 5, which are indicated only schematically for clarity, can be structured according to any desired embodiment known from the state of the art. Bindings 4, 5 are connected with each other by length adjustment device 12, i.e. its drive elements 18, 19 and gear 20. To set length adjustment device 12 in place during the adjustment process of bindings 4 or 5, length adjustment device 12 can be fixed in place by means of lock 22, namely the locking bolt 41 on base plate 40. Locking plate 31, which can be pivoted around the axis 49, has locking bolt 41. The activation of locking plate 31 and its structure, however, can take place corresponding to the structure in FIGS. 4 to 6. Fixing device 37 is not needed, since locking plate 31 can only be used when the coupling device is not used for skiing.

Toe and heel bindings 4, 5, in contrast, can be fixed in place on ski 2, either directly on ski 2 or on a holder plate 57, 58. Each binding 4 and 5 is equipped with its own locking device 55, 56, which can also be structured as a longitudinal guide. The drive elements 18, 19 are each connected to move directly with bindings 4, 5. During operation, toe binding 4 and heel binding 5 can be locked in place with locking device 55, 56, for example, which includes locking elements 60 which can be adjusted via an eccentric lever 59. Gear 61 engages with a gear strip 62 of holder plates 57, 58. Bindings 4, 5 are therefore arranged to be fixed in place during use of ski 2, i.e. during adjustment of coupling device 1. Thus, the deformation of ski 2 is compensated by a free adjustment of length adjustment device 12. For this purpose, length adjustment device 12 can also be provided with a coupling 63, which can be uncoupled, for example, when locking plate 31 is pivoted down into its closed position 32 shown in FIG. 6. This allows free and unhindered movement of drive elements 18, 19, relative to one another, in the longitudinal direction.

To adjust distance 14 or 15 of bindings 4 and 5, length adjustment device 12 is first fixed in place relative to base plate 40 of ski 2. Length adjustment device 12 is fixed in place by opening locking plate 31, i.e. engaging locking bolt 41, whereupon locking devices 55, 56 are opened by pivoting eccentric lever. 59. For this purpose, locking elements 60 are pulled together by means of tension spring 64 located between them, so that the gear 61 and gear strip 62 no longer engage. Bindings 4, 5 are restricted from lateral movement but are free to be moved in the direction of longitudinal axis 21 of the binding. The distance between bindings 4, 5 can now be adjusted with length adjustment device 12.

Once adjusted, bindings 4, 5 are locked in place with locking devices 55, 56, and lock 22 is disengaged by pivoting the locking plate 31 into closed position 32.

Of course, it is also possible to structure locking devices 55 and 56 in any desired manner. Thus, it is possible, among other things, to fix only one of bindings 4, 5 in place on the ski with holder plates 57, 58. This connection can also be made with screws, directly into holder plate 57, 58, or in corresponding holder bores in ski 2. The other binding 5 or 4 can then be movable in the longitudinal direction freely within holder plate 57 formed as a longitudinal guide. It would then be necessary to provide a locking device 29 for length adjustment device 12, as described in FIGS. 4 to 6. Thus, one of bindings 4 or 5 can be fixed in position on ski 2, for example screwed on, while the other binding is movable during use. However, both bindings 4, 5 can also be fixed in place on ski 2. Rapid adjustment of bindings 4, 5 to different distances 14 or 15 can nevertheless be achieved, since after release of locking devices 55 and 56, an adjustment proceeding centrally from the center point or assembly point 10 of ski 2 is possible.

Figure 8:
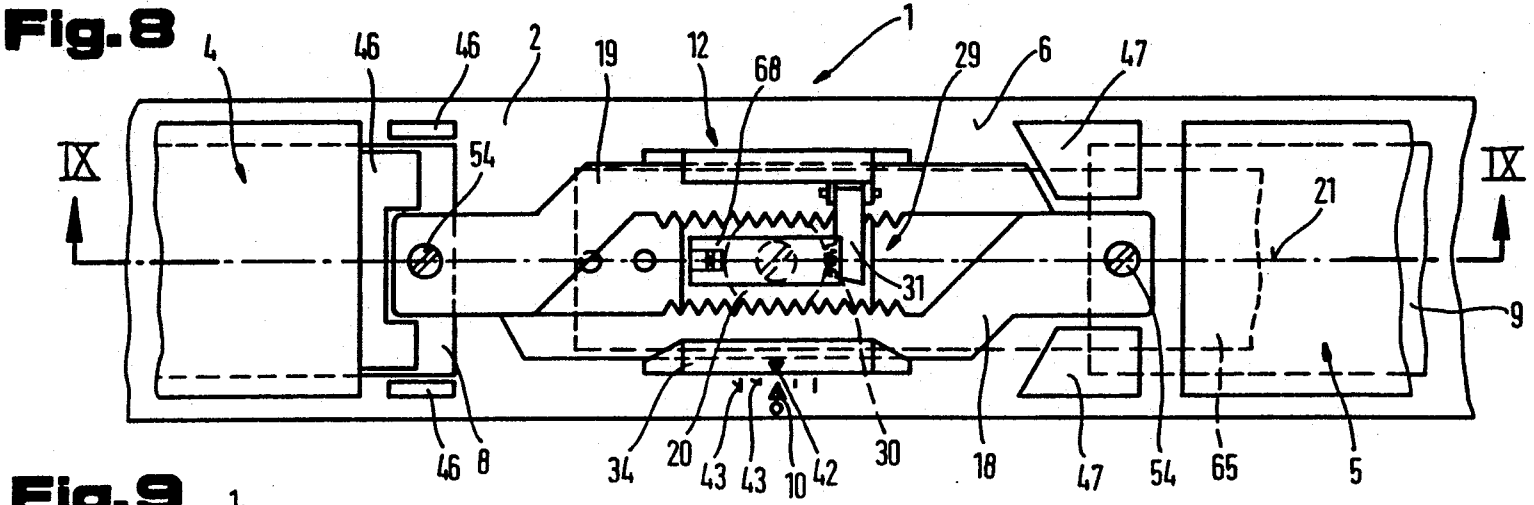
FIG. 8 is an enlarged top plan view of another embodiment of the binding.
Figure 9:
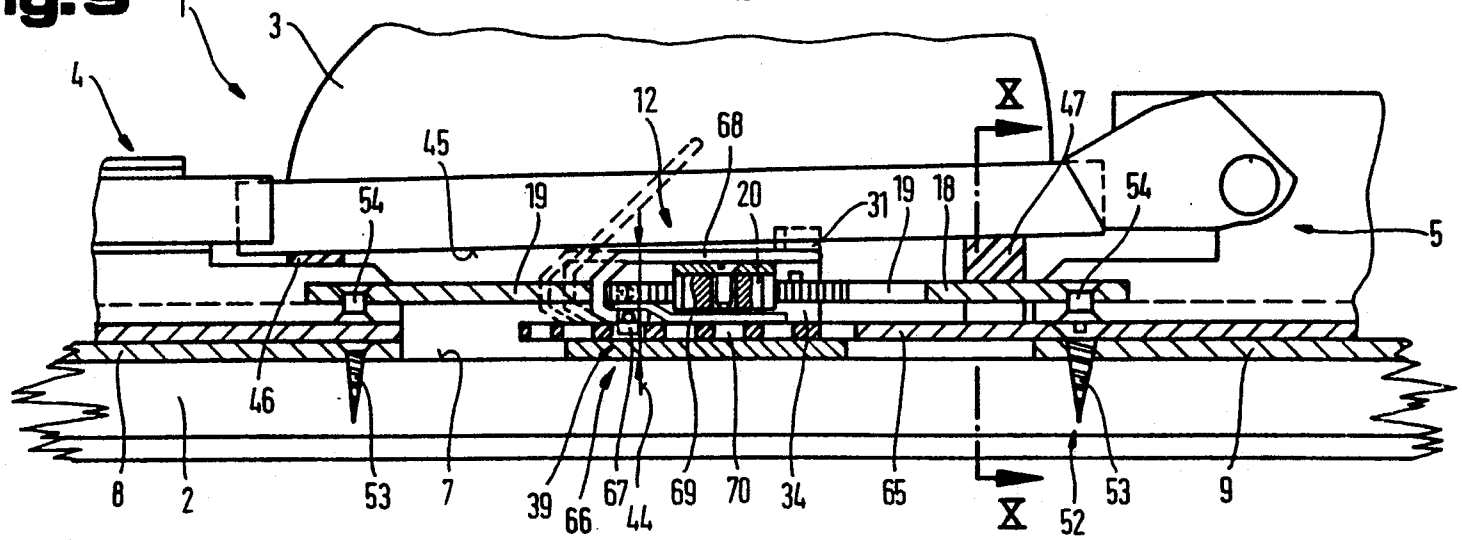
FIG. 9 is an enlarged cross-sectional view taken along line IX—IX of FIG. 8.
Figure 10:
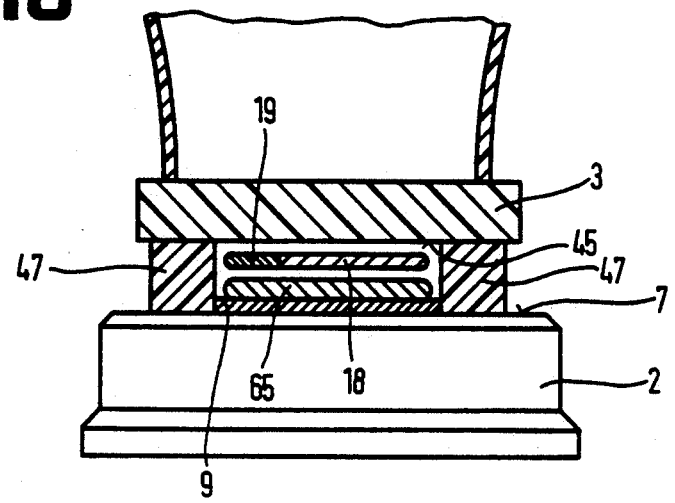
FIG. 10 is an enlarged cross-sectional view taken along line X—X of FIG. 9.

FIGS. 8 to 10 show another embodiment of coupling device 1 where during use toe binding 4 and heel binding 5 can be moved independently of one another and the ski in longitudinal guides 8 and 9. The connection and adjustment of the distance between the toe binding 4 and heel binding 5 is controlled by length adjustment device 12, which is arranged between toe and heel bindings 4, 5. Since the basic structure essentially corresponds to the structure of FIGS. 1 to 7, the same reference symbols will be used.

Each binding 4, 5 is coupled with a drive element 18 or 19 by attachment means 54 for common movement. Drive elements 18, 19 are connected for synchronous movement, in opposite directions, through gear 20, for example a gear wheel, which is arranged between them. The gear can be formed by a positive lock gear mechanism or equivalent means. In order to allow a free vertical mobility of length adjustment device 12, it is connected with ski 2 via a connection element 65. Connection element 65 is shown near heel binding 5 including attachment means 52, for example screws 53. This connection element is elastically deformable in the direction perpendicular to fixed plane 6 but resistant to tensile and compressive forces as well as resistant to lateral deformation along longitudinal axis 21. This ensures that length adjustment device 12 is always held in place and centered on assembly point 10, in the direction of the longitudinal axis of the binding. On the other hand, ski 2 is freely deformable relative to the entire coupling device. Connection element 65 serves as part of variable attachment means 39 in this regard.

Variable attachment means 39 can furthermore have a locking device 66 arranged between connection element 65 and length adjustment device 12. Connection element 65 passes through holder housing 34 of length adjustment device 12, e.g. below drive elements 18, 19 and gear 20. Locking tab 67 is arranged on an eccentric pivot lever 68 and a pressure spring 69, for example structured as a compound spring. Pressure spring 69 is arranged under tension in holder housing 34 of length adjustment device 12. Pressure spring 69 maintains locking tab 67 in one of the recesses 70 of connection element 65.

In addition, locking device 29 formed by an additional locking plate 31 which engages with drive element 20, which is formed by a gear wheel, for example. With locking element 31, i.e. catch 30, the position of drive gear 20 is fixed so that the position, i.e. the distance between toe and heel bindings 4, 5, is maintained during operation once locking device 29 engages.

Because the adjustment device is held in a precise position in the longitudinal direction due to connection element 65, bindings 4 and 5 can now be freely adjustable in their longitudinal guides 8, 9. Despite this, a fully functioning coupling device 1, which can also be used as a safety binding, is achieved. With the optional eccentric pivot lever 68 or locking device 66, the entire coupling device 1, consisting of bindings 4, 5, can be adjusted relative to ski 2 with its preselected safety position and the distance between toe and heel bindings remaining the same. This makes it possible to adjust the size of coupling device 1 to the individual needs of the user. Nevertheless, the central fixation and adjustability of the distance between the bindings 4, 5 for different boot sizes is maintained, which is particularly advantageous as a rental ski binding.

The embodiment in which only connection element 65 is provided without locking device 66 is very cost effective, and, therefore, useful for rental ski bindings. However, due to the short set-up times, the addition of locking device 66 for rental skis offers the advantage that the entire coupling device 1 can be rapidly adjusted in the longitudinal direction to match the different ability of the user. Thus, in the case of a beginner who has practically no knowledge of skiing, going around curves is facilitated if the center point of coupling device 1 is arranged between the assembly point on ski 2 and the ski end, because in this way, the pressure on the ski tip is reduced and going around curves is made easier. If the skier, on the other hand, applies too little pressure onto the tip of ski 2, due to unfamiliarity or fear, causing him to lean back, then it is possible to move the center point of the coupling device 1 from the assembly point in the direction of the ski tip, which achieves better lateral hold, particularly on hard and icy trails.

As is furthermore evident from the schematic representations of FIGS. 8 and 9, the arrangement of eccentric lever 68 and locking element 31 is selected in such a way that if they are not closed or locked properly, they project forward into the area of ski boot 3 and thus entry of ski boot 3 into the coupling device 1 is prevented. If, for example, the locking plate 31 is not properly engaged, it comes to rest on the eccentric pivot lever 68—as shown in FIG. 9—and thus entry of a ski boot 3 into the coupling device 1 is reliably prevented.

Figure 3:
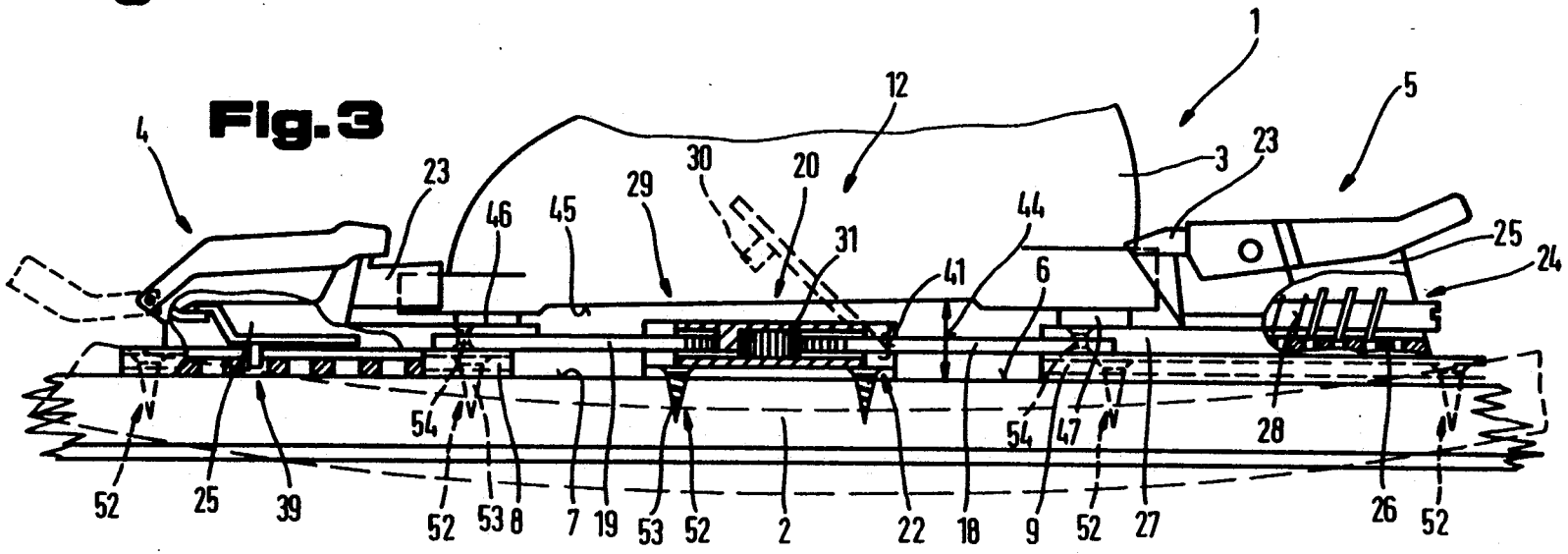
FIG. 3 is an enlarged side elevational view, in partial cross section of the coupling device.

FIGS. 8 to 10 also show that separate standing plates 46, 47 for ski boot 3 are provided, which in turn can be arranged or structured according to the description of FIG. 3. Of course, it is also advantageous in this embodiment if the height of length adjustment device 12 is less than distance 44 between surface 7 of ski 2 and the side of boot sole 45 facing it. This also allows so-called negative flex of ski 2, in other words bending of ski 2, or free oscillation of the same from the extended zero position in the direction of boot sole 45.

Furthermore, it is evident from FIG. 10 that standing plates 46 and 47 are structured in such a way that there is sufficient space between boot sole 45 and surface 7 of the ski 2 for free unhindered passage of connection element 65 and drive element 18. It should be noted that free adjustability of ski 2 relative to coupling device 1 is sufficient if it is present in the vertical direction to adjust bindings 4, 5 only at slight deformation movements, i.e. bending of ski 2 in the stress direction. Also, it must be ensured that there is sufficient play in the vertical direction for length adjustment device 12, i.e. drive element 18, 19 and gear 20, between standing plates 46 and 47.

Figure 11:
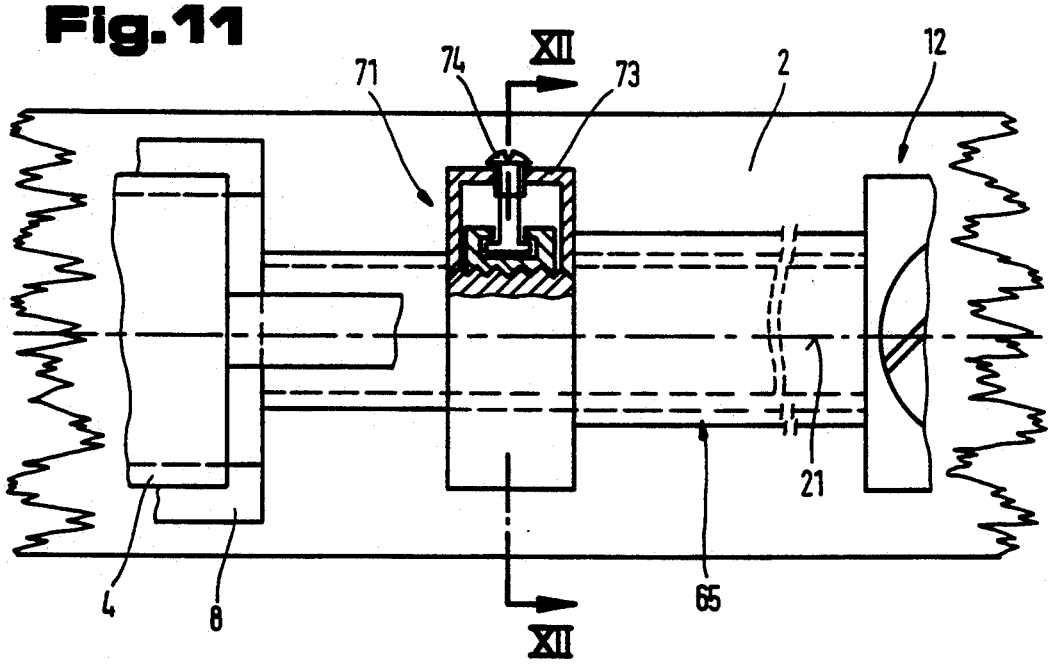
FIG. 11 is an enlarged top plan view, in partial cross section, of an alternate embodiment of the attachment means for the coupling device.
Figure 12:
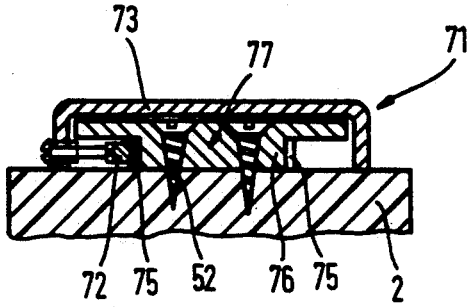
FIG. 12 is an enlarged cross-sectional view taken along line XII—XII of FIG. 11.

FIGS. 11 and 12 show another variation for a locking device 71 between connection element 65 and ski 2. Connection element 65 holds length adjustment device 12 in the longitudinal direction.

To adjust length adjustment device 12 on an assembly point of ski 2, locking device 71 is provided with a clamp 72, which is mounted in a housing 73, and adjustable with a screw 74. This clamp works together with gear strips 75 along with a flat T-profile guide track 76 on both sides of a web 77. Guide track 76 which establishes height and width is attached to ski 2 via attachment means 52, and can be used not only for mounting and holding locking device 71, but also for mounting longitudinal guides 8, 9 for bindings 4, 5. Guide track 76 can extend over a greater length of ski 2 and preferably counteract the bending of ski 2 by providing a slight moment of resistance in the vertical direction. Even short longitudinal guides can be effective in this manner. Also, the assembly point of the coupling device can be adapted to the user of ski 2 in each case, referring to the assembly point indicated by the ski manufacturer.

Figure 13:
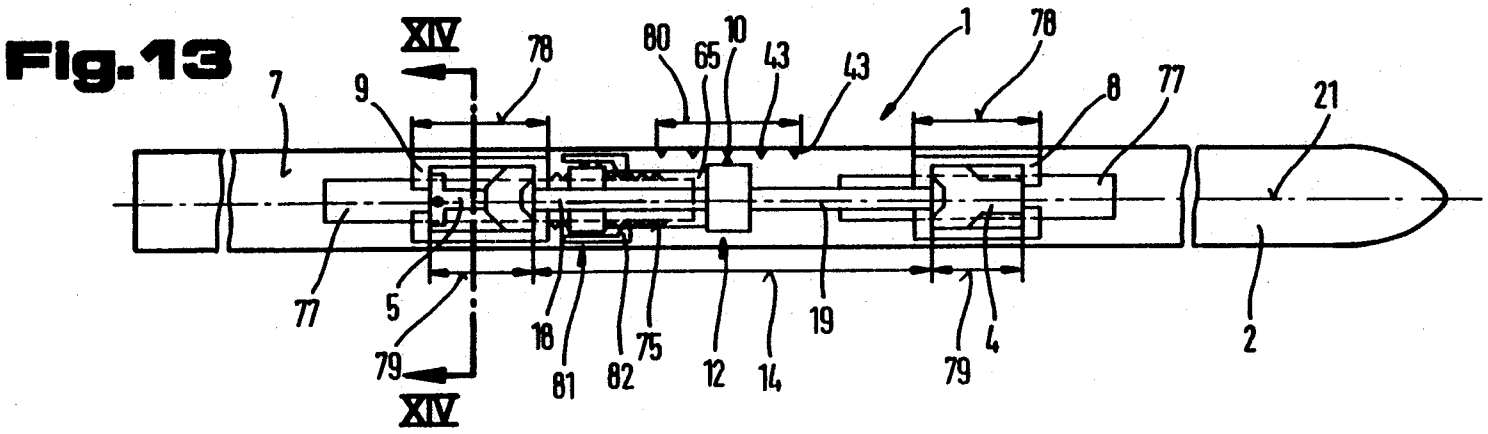
FIG. 13 is a top plan view of another embodiment of the coupling device.
Figure 15:
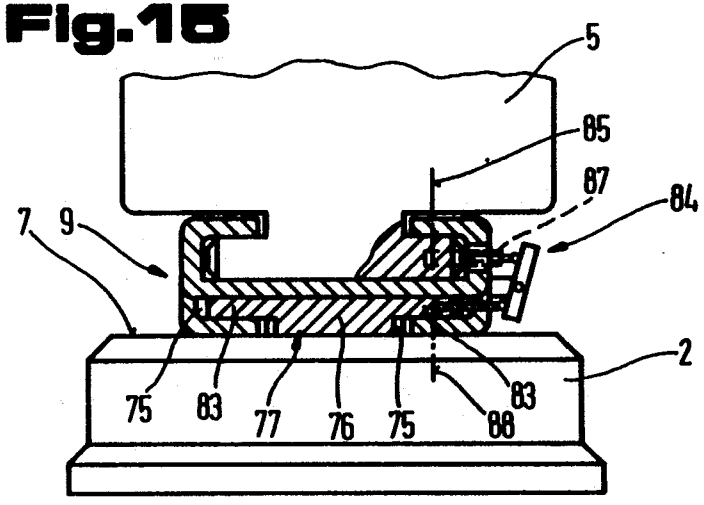
FIG. 15 is an enlarged cross-sectional view of yet another embodiment of the binding with a fixing device.
Figure 14:
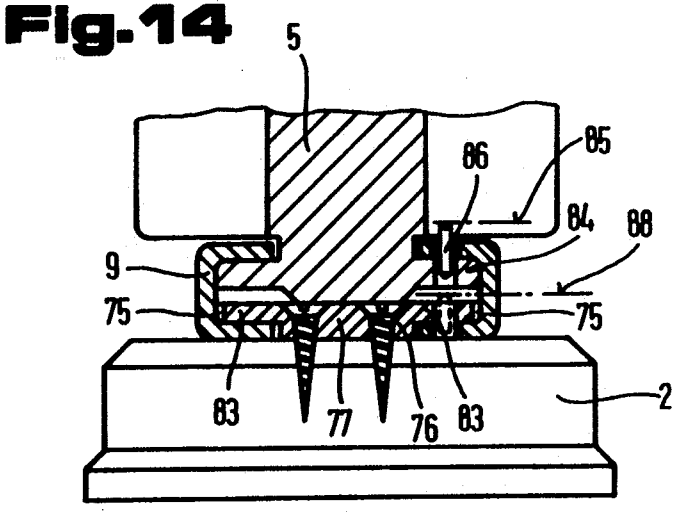
FIG. 14 is an enlarged cross-sectional view of the heel binding guide taken along line XIV—XIV of FIG. 13.

FIGS. 13 to 15 show another embodiment of coupling device 1 according to the invention in which length adjustment device 12 and longitudinal guides 8, 9 position bindings 4, 5. Distance 78 of longitudinal guides 8, 9 corresponds to a guide length 79 of bindings 4, 5, plus at least half the adjustment range 80 by which the assembly point of the coupling device can be adjusted relative to the assembly point 10 indicated by the ski manufacturer. In the area of both bindings 4, 5, a height and width guide track 76 is arranged in each case, which has an approximately T-shaped or swallowtail-shaped cross section, as already explained in connection with FIGS. 11 and 12. Of course, it is also possible to simply use a flat strip, into which a groove is milled on both sides, in which bindings 4, 5 or longitudinal guide 8 or 9 are movably mounted.

Length adjustment device 12 can be structured, for example, to be aligned and fixed in place on assembly point 10 of ski 2 via a length positioning device 81. By means of length positioning device 81, it is possible, among other things, to adjust length adjustment device 12 from positioning marks 43 arranged on both sides of assembly point 10. This allows individual adaptation of the position of coupling device 1 on ski 2, in order to achieve the advantages already described above. For this purpose, length positioning device 81, as schematically shown in FIG. 13, can engage web 77, i.e. the shanks 83 of the height and width guide track 76.

Catches 82 placed on gear strips 75 can be pivoted mechanically against the biasing force of springs. Drive elements 18 and 19 of the length adjustment device are each connected to move with toe binding 4 or heel binding 5.

Between longitudinal guide 8 or 9 and toe and heel binding 4, 5, and between the height and width guide track 76, a fixing device 84 is arranged which is adjustable between two positions. The first is a locked position which connects toe or heel binding 4, 5 to longitudinal guide 8 or 9, as shown in FIG. 4, and the second is a locked position which connects height and width guide track 76 to longitudinal guide 8 or 9.

Altering the distance 14 or 15 between toe and heel binding 4, 5 takes place in the following manner: Before each adjustment or change of distance 14 or 15 between bindings 4, 5, fixing device 84 is adjusted to its release position 85 as shown in FIG. 14, in which longitudinal guide 8 is connected to move with toe binding 4. In the same way, fixing device 84 in the area of heel binding 5, which can be structured as shown in FIG. 14 for the toe binding, or like the fixing device shown in FIG. 15, is brought into a catch position. Then the locking device for fixing drive elements 18, 19 in place is released for a preselected distance. The distance 14 or 15 between toe and heel bindings 4, 5 is changed by length adjustment device 12. For this purpose, bindings 4, 5 are pushed along the height and width guide track 76, together with the related longitudinal guide 8, 9, until the desired distance 14 is reached. Then a locking lever 86 or 87 of the fixing device 84 is adjusted from release position 85, shown in solid line in FIG. 14, into the catch position 88, shown in phantom lines. The position of longitudinal guide 8, 9 relative to the height and width guide track 76 is fixed, and the movement of bindings 4, 5 relative to the longitudinal guides 8, 9 is released.

Simultaneously, or any time earlier, the position of drive elements 18, 19 is fixed in place in length adjustment device 12, by means of the locking device. In this way, the entire coupling device 1, i.e. the unit consisting of drive elements 18, 19, and bindings 4, 5, is now fixed in place on ski 2 via connection element 65. Connection element 65 is structured to be elastically deformable and bendable in the direction perpendicular to surface 7 but resistant to tensile and compressive forces in the longitudinal direction, as well as rigid against bending in the standing plane lateral to longitudinal axis 21.

Surprisingly, this simple arrangement provides an adjustable binding with only very slight rigidity of the ski. The length of longitudinal guide 8 or 9 only has to be designed for the dimensions required for adaptation to the center point of coupling device 1 in relation to the assembly point on ski 2. Longitudinal guides 8 and 9 also account for length equalization between coupling device 1 and ski 2 during bending of ski 2. These longitudinal guides 8, 9 can now be structured to be rigid in the direction of the longitudinal axis so that precise and low-friction guidance of bindings 4, 5 is achieved. Height and width guide track 76 presents only a slight moment of resistance due to bending of ski 2, and hardly changes the deformation properties of ski 2, in addition to the large adjustment range. This now makes it possible to utilize a single coupling device 1 over all ranges of boot sizes, from the smallest ladies' size to the largest men's size, without reassembly of attachment parts, such as longitudinal guides 8, 9, length adjustment devices 12, etc.

Figure 16:
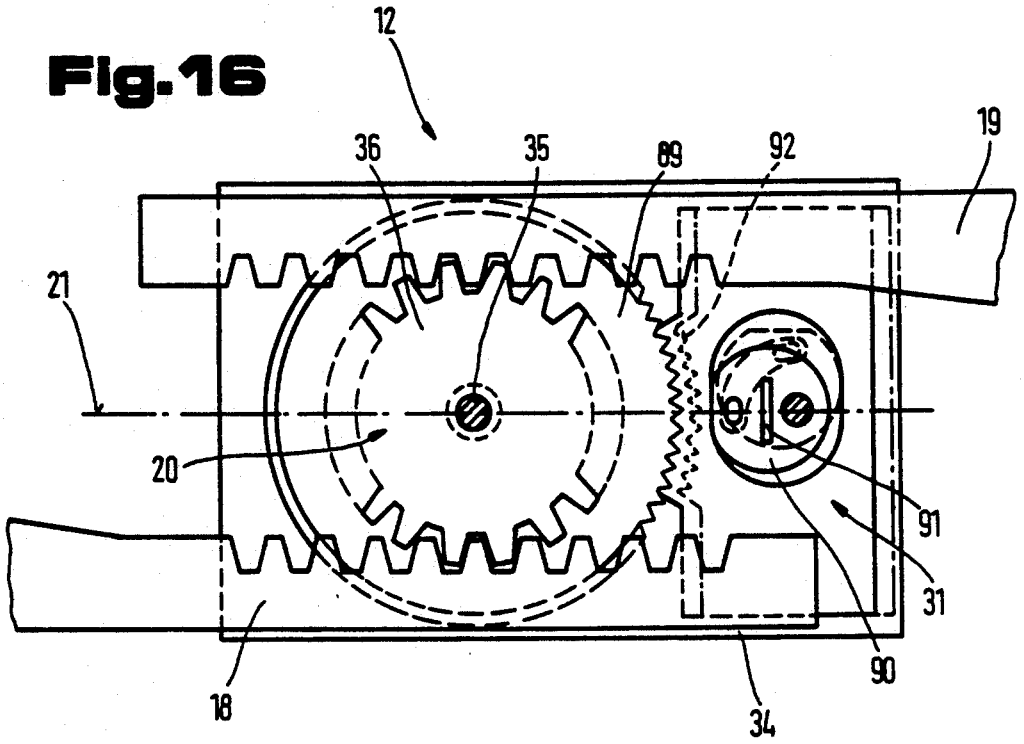
FIG. 16 is an enlarged top plan view, in partial cross section, of a further embodiment of the lock.
Figure 17:
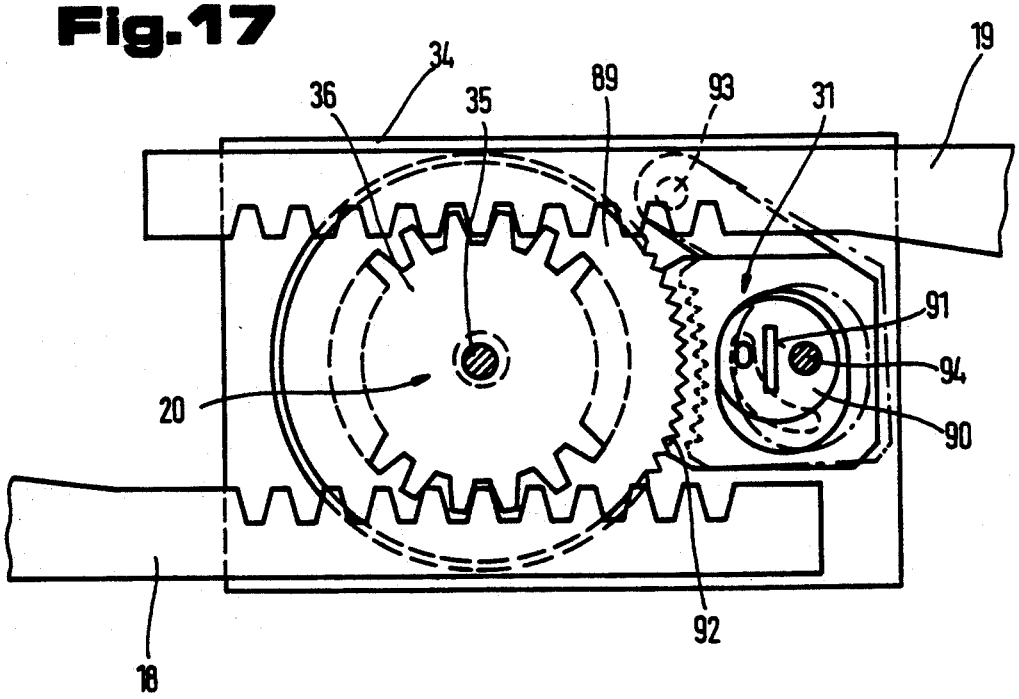
FIG. 17 is an enlarged top plan view, in partial cross section, of an alternate embodiment of the lock.

FIGS. 16 and 17 show variations for drive element 18, 19 and gear 20. Gear wheel 36, which rotates about axis 35, provides synchronous movement of drive elements 18, 19, but in opposite directions. Gear wheel 36 is connected to move with a second gear wheel 89 or a crown gear flanged directly thereon. A locking element 31 is assigned in the holder housing 34 of the length adjustment device 12, which can be adjusted from a locking position in which it is engaged with the gear wheel 89, shown in solid lines, into an open position, shown in phantom, by means of an eccentric disk 90. For this purpose, eccentric disk is simply pivoted from the position shown with solid lines into the position shown in phantom. Eccentric disk 90 can be provided with an activation slit 91 or a hexagonal head or similar for this purpose. The locking element 31 is provided with corresponding gearing 92 on its side facing the gear wheel 89. Instead of the gearing 92, however, a friction covering or a high-strength elastic element, made cf solid rubber or similar, can also be used to prevent rotation of gear wheel 89.

The embodiment shown in FIG. 17 differs from the one described above merely by the arrangement or mounting of the locking element 31, and therefore the same reference symbols are again used for the same parts.

While locking element 31 is arranged movable in the direction of longitudinal axis 21 within the holder housing 34 in the embodiment of FIG. 16, the locking element 31 can pivot around a pivot axis 93 in the embodiment according to FIG. 17. Eccentric disks 90 can each pivot around an axis 94 mounted in the holder housing 34. With the use of such locking elements 31, which can be activated in such simple manner, the position of drive elements 18, 19 and gear 20 can be easily blocked.

Figure 18:
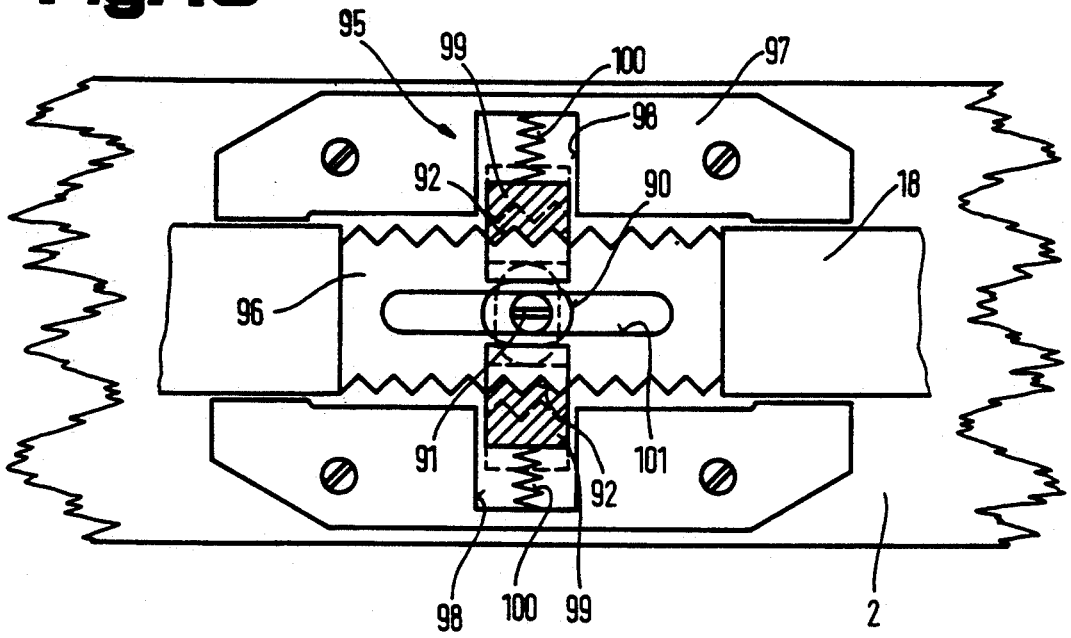
FIG. 18 is an enlarged top plan view of yet another embodiment of the lock.

In the embodiment in FIG. 18, a locking device 95 for a drive element 18 or 19 is shown, for example, near binding 4 or 5. For this purpose, drive element 18 is provided with a gear strip part 96 inserted in between, and held in place in its position relative to a housing 97 of the locking device 95, which is screwed or glued onto ski 2, for example. Two locking elements 99 are tensed in lateral guides 98, by means of springs 100, in the direction of the gear strip part 96. These locking elements 99 are provided with a gearing 92 which is reciprocal to the gear strip part 96. The two locking elements 99 are supported on an eccentric disk 90 with their front sides, facing other. The disk can be activated via an activation slit 91, which can be arranged on a tab projecting through the gear strip part 96 in a long hole 101. In the position of the eccentric disk 90 shown with solid lines, the gearing 92 of the locking elements 99 engages with the gearing of the gear strip part 96. When the activation slit 91 is rotated by 90 degrees, the two locking elements 99 are pressed apart against the effect of the springs 100, to such an extent that the gearing of these elements and the gear strip part 96 no longer engages, and the gear strip part 96 can therefore be adjusted using the drive element 18.

With this structure, length adjustment device 12 need not be equipped with a locking device. Only one drive element 18 or 19 need be locked since drive elements 18, 19 and gear 20, if coupled, prevent adjustment of the unlocked drive element.

Figure 19:
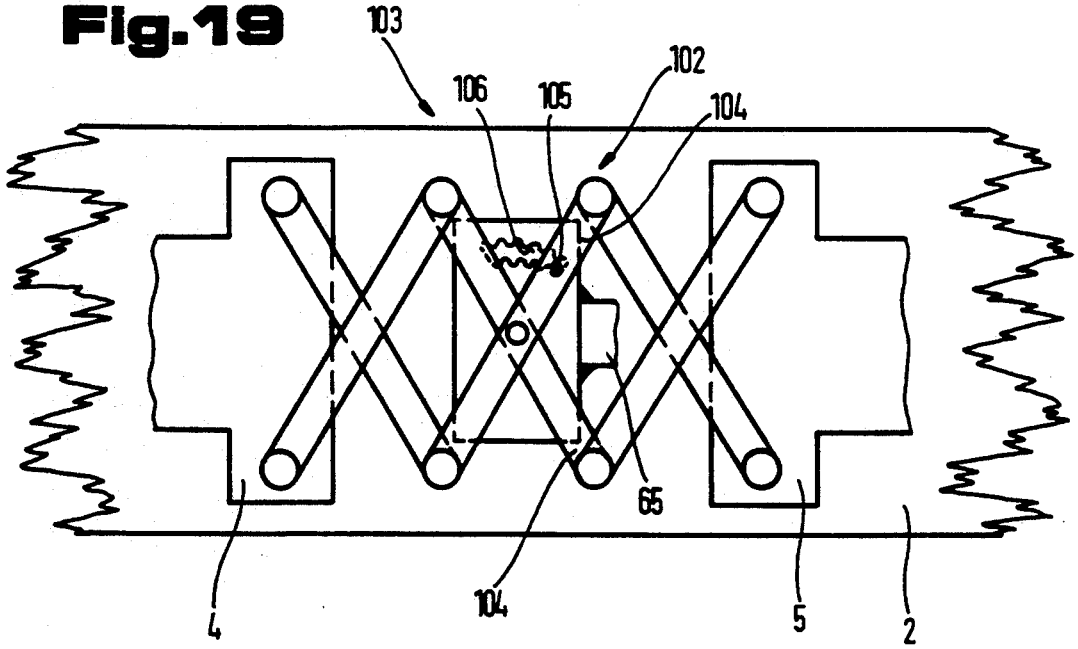
FIG. 19 is an enlarged top plan view of a further embodiment of the coupling device.

FIG. 19 shows another embodiment in which a locking device 102 is formed by a scissors arrangement 103. The ends of the scissors arrangement 103 are connected to move with toe and heel bindings 4, 5, while the scissors arrangement in the middle area of ski 2 is preferably connected with the ski via a connection element 65, in the manner described above.

To lock the scissors arrangement 103 in place, it is possible to use a pin 105 which penetrates the one scissors arm 104 and can be inserted in a perforated catch strip 106.

With all the embodiments of the length adjustment device described above, the individual drive elements 18, 19 and gear 20 or the holder housing 34 can be provided with markings, which indicate the positions for different boot sizes. In this manner, the rough adjustment of distance 14 or 15 between bindings 4, 5 can be carried out without the ski boot 3 having to be inserted into coupling device 1.

FIG. 20 shows a further variation of length adjustment device 12 for manual movement of bindings 4, 5. The drive elements 18, 19 can be moved lengthwise in the longitudinal direction of ski 2 with guide elements 110, 111. Drive elements 18 and 19 have gear arrangements 113 at opposite longitudinal side edges 112. The locking elements 31 mounted to move lateral to the longitudinal ski direction between the drive elements 18, 19 engage with these gear arrangements and their reciprocal gearing 114. Locking elements 31 are held in place in the engaged position, for example by spiral springs 115, which act as pressure springs. By applying a force against the effect of the spiral springs 115, locking elements 31 are disengaged, which makes it possible to adjust bindings 4, 5 in the longitudinal direction of the ski. After the adjustment has been carried out, locking elements 31 are brought back into engagement by means of the effect of the spiral springs 115, and the drive elements 18, 19 are fixed in place in their positions relative to one another and to ski 2.

In FIG. 21, length adjustment device 12 is formed by a sliding block 116, which is adjustable lateral to the longitudinal ski direction by means of a threaded spindle 117. The sliding block 116 is a cylindrical device 118, for example, which is guided in sliding tracks 119, 120 which are arranged in the drive elements 18, 19, for example. The sliding tracks 119, 120 are formed by slots 121, which form an angle 122 relative to one another, which is bisected by a center axis 123 of the threaded spindle 117 which runs lateral to the longitudinal ski direction. By turning the threaded spindle 117, which is mounted to rotate on the ski 2, the position of the sliding block 116 along the threaded spindle 117 is changed, and drive elements 18, 19 are adjusted and fixed in place relative to one another and synchronously with reference to the center axis 123, via the sliding tracks 119, 120.

In FIG. 22, the locking device 29 of the drive element is shown by means of a bent-lever activated locking tab 124. The locking tab 124, which is guided in a guide element 125, engages with recesses 126 arranged on the circumference of the drive element 20. In the extended position, locking tab 124 prevents drive element 20 from being adjusted. A bent lever 130 is activated by means of a slide element 129 which is adjustable along a double arrow 128 by means of an eccentric drive 127. This lever is connected to rotate with the locking tab 124, and with a spring-mounted counter-bearing 131 on the opposite side.

FIGS. 23 and 24 show locking device 29 and a locking element 31 which is arranged to pivot in a hinge arrangement 132. Locking element 31 engages in a gearing 133 arranged on the circumference of drive element 20. The locking element 31 is held in this locking position by a spring-loaded bolt element 134. After a force is applied in the direction of an arrow 135, the bolt element 134 is pushed against spiral spring 136, allowing locking element 31 to be disengaged from gearing 133 of drive element 20 by pivoting it up, in order to eliminate the locking.

FIG. 25 shows the locking device 29 including a locking element 31 which can be pivoted against the effect of the spiral spring 136, into the gearing 133 of the drive element 20 with the counter-gearing 114. The locking element 31 can be pivoted around a pivot axis 137 which is arranged to run parallel to the plane of the wheel-shaped drive element 20, against the effect of the spiral spring 136, and can be brought into engagement with the drive element 20. A steering strip 139 which can be moved in a guide 138 relative to the locking element 31 causes locking or unlocking of the locking element 31, in accordance with the movement of a steering strip 139, according to the double arrow 140.

Figure 26:
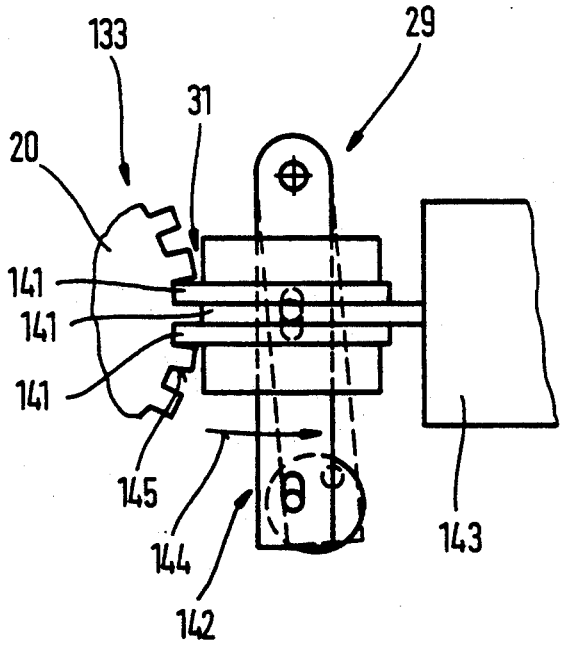
FIG. 26 is an enlarged top plan view of an alternate embodiment of the lock with a pivot lever.

FIG. 26 shows locking device 29 with blades 141 which are brought into engagement with the gearing 133 of the drive element 20. These blades are bundled together and mounted to be displaced relative to one another. The blades 141 are moved in the direction of the drive element 20, or in the direction of a contact element 143, according to an arrow 144, via an eccentric pivot lever 142. This arrangement of several blades 144 ensures that at least one of the blades 141 engages with the recess 145, independent of the position of the drive element 20 and its gearing at any particular time.

Of course it is possible, within the scope of the invention, to change the arrangement of the individual elements as desired, or to combine them in different ways.

Individual characteristics of the embodiments shown can also form independent inventive solutions.

In conclusion, it should also be stated that for a better understanding of the invention, individual parts were shown distorted and enlarged, not to proportional scale, and in simplified schematic form, in the drawings.

What is claimed is:

1. An adjustable coupling device for coupling a ski boot to a ski, the coupling device having a longitudinal axis comprising:

a toe binding;

a heel binding;

length adjustment means for altering the distance between the toe binding and the heel binding along the longitudinal axis of the coupling device to accommodate different size ski boots, said length adjustment means having a first drive element connected to said toe binding and a second drive element connected to said heel binding;

means for synchronously moving said first and second drive elements;

means for setting said drive elements at a position corresponding to the length of the ski boot; and attachment means to attach one of said bindings to a surface of the ski at one of several preset positions, the remainder of the coupling device being unattached to the ski so that the remainder of the coupling device can move freely in a direction perpendicular to the surface, whereby the distance between said toe binding and said heel binding remains substantially constant during bending of the ski.

2. The coupling device according to claim 1, wherein said drive elements are movable in opposite directions from each other.

3. The coupling device according to claim 2, wherein said length adjustment means, additionally includes locking means to lock said first and second drive elements in place.

4. The coupling device according to claim 3, wherein the position of the length adjustment means can be altered along the longitudinal axis by adjusting said attachment means.

5. The coupling device according to claim 4, wherein said attachment means has a plurality of preset positions located along the longitudinal axis.

6. The coupling device according to claim 5, wherein said length adjustment means additionally includes locking means for locking the length adjustment means at a particular setting.

7. The coupling device according to claim 6, wherein said locking means has a locking plate which is adjustable between a closed position and an open position, wherein said locking means prevents movement of said length adjustment means when placed in said closed position.

8. The coupling device according to claim 7, wherein said locking means locks said drive elements against movement in the longitudinal direction as well as in a direction perpendicular to the surface.

9. The coupling device according to claim 6, wherein said locking means are adjustable between an open and a closed position and are formed by a coupling which is located between said drive elements wherein said coupling is uncoupled when said locking means is in a closed position.

10. The coupling device according to claim 9, wherein the coupling is coupled when said locking means are in the open position.

11. The coupling device according to claim 10, wherein said locking means are located between the toe and heel bindings.

* * * * *